US009197957B2

(12) United States Patent
Zhang et al.

(10) Patent No.: US 9,197,957 B2
(45) Date of Patent: Nov. 24, 2015

(54) ELECTRONIC DEVICE POWERED THROUGH EARPHONE INTERFACE AND EARPHONE POWER LINE

(71) Applicants: AMBIT MICROSYSTEMS (SHANGHAI) LTD., Shanghai (CN); HON HAI PRECISION INDUSTRY CO., LTD., New Taipei (TW)

(72) Inventors: Ye Zhang, Shanghai (CN); Xiao-Feng Liu, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 284 days.

(21) Appl. No.: 13/866,044

(22) Filed: Apr. 19, 2013

(65) Prior Publication Data

US 2014/0211958 A1 Jul. 31, 2014

(30) Foreign Application Priority Data

Jan. 30, 2013 (CN) ..... 2013 1 0036713

(51) Int. Cl.
*H04R 1/10* (2006.01)

(52) U.S. Cl.
CPC ..... *H04R 1/1041* (2013.01)

(58) Field of Classification Search
CPC ..... H04R 5/033; H04R 1/1041
USPC ..... 381/74
See application file for complete search history.

(56) References Cited

U.S. PATENT DOCUMENTS

2008/0164994 A1* 7/2008 Johnson et al. ..... 340/533
2012/0294454 A1* 11/2012 Sakamoto et al. ..... 381/66

FOREIGN PATENT DOCUMENTS

CN 2789812 Y 6/2006
KR 10-2009-0007892 A 1/2009
TW 201019745 A 5/2010

* cited by examiner

*Primary Examiner* — Simon King
(74) *Attorney, Agent, or Firm* — Novak Druce Connolly Bove + Quigg LLP

(57) ABSTRACT

An electronic device receives power through an earphone interface, and includes the earphone interface, a processing unit, an audio codec chip, a first switch and a second switch. The earphone interface includes a left channel pin, a right channel pin, a ground pin and a microphone pin. The first switch includes a first normally closed terminal, a first normally open terminal, a first common terminal and a first controlled terminal The second switch includes a second normally closed terminal, a second normally open terminal, a second common terminal and a second controlled terminal. The processing unit includes a detect pin and a switch control pin. An earphone power line to power the electronic device is also provided.

12 Claims, 3 Drawing Sheets

ELECTRONIC DEVICE POWERED THROUGH EARPHONE INTERFACE AND EARPHONE POWER LINE

BACKGROUND

1. Technical Field

The disclosure relates to electronic devices, and particularly to an electronic device powered through an earphone interface and an earphone power line.

2. Description of Related Art

A typical portable electronic device has a multitude of interfaces, for example, an earphone interface, a power interface, a Universal Serial Bus (USB) interface, and others. The large number of interfaces increases the manufacturing costs of the portable electronic device, and may detract from the aesthetic appeal of the portable electronic device.

DETAILED DESCRIPTION

Figure 1:
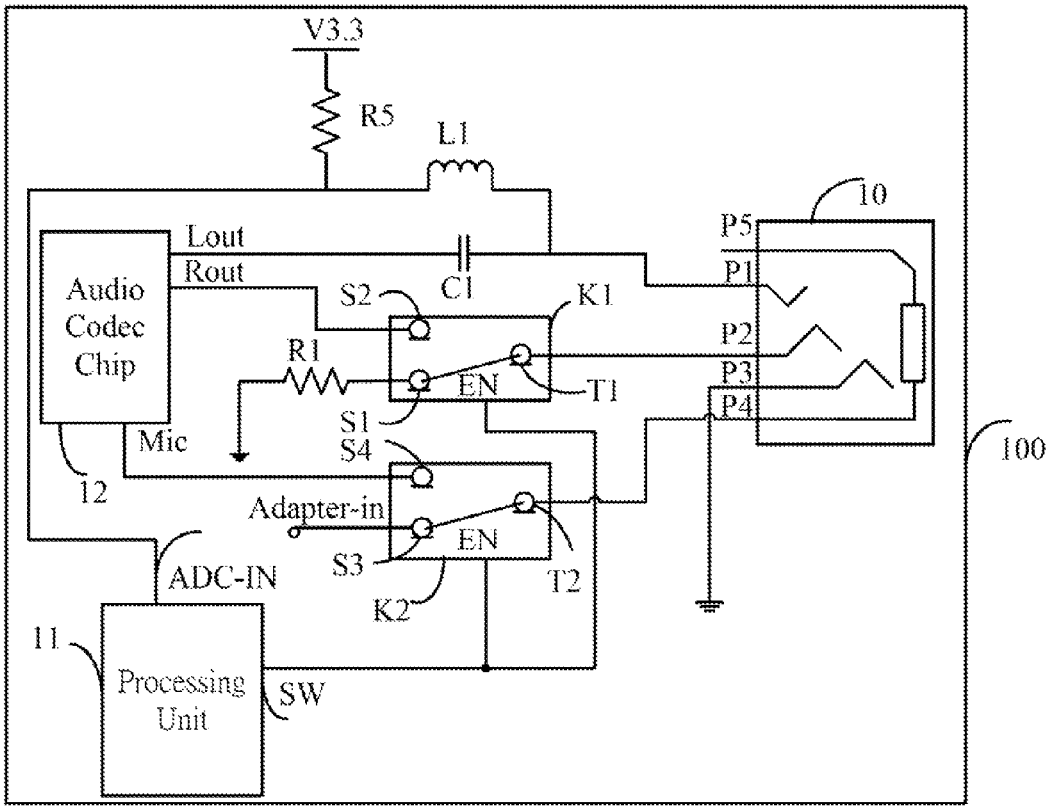
FIG. 1 is a circuit diagram of an electronic device in accordance with one embodiment of the present invention.
Figure 2:
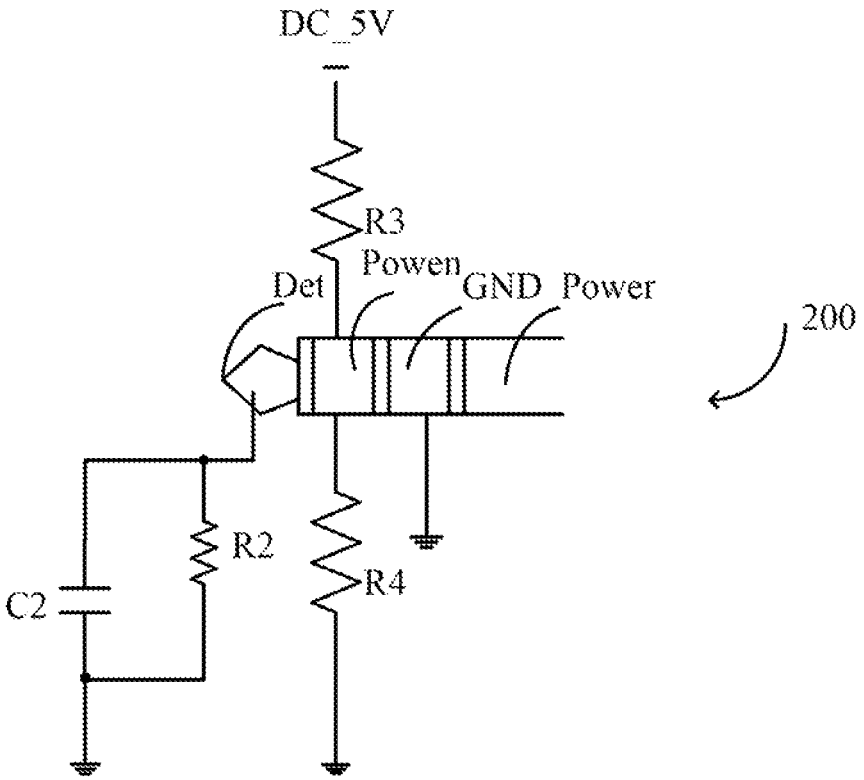
FIG. 2 is a schematic diagram of a plug of an earphone power line and circuitry thereof, in accordance with one embodiment of the present invention.

FIG. 1 is a circuit diagram of one embodiment of an electronic device 100 that can be powered through an earphone interface 10 thereof. Referring also to FIG. 2, an earphone power line 200 connects with the earphone interface 10, and provides power for the electronic device 100 through the earphone interface 10.

FIG. 1 shows that the electronic device 100 further includes a processing unit 11, an audio codec chip 12, a first switch K1 and a second switch K2. The earphone interface 10 includes a left channel pin P1, a right channel pin P2, a ground pin P3, a microphone pin P4, and a vacant pin P5. The audio codec chip 12 includes a left channel output pin Lout, a right channel output pin Rout, and a microphone input pin Mic.

The first switch K1 and the second switch K2 are single pole, double throw (SPDT) switches. The first switch K1 includes a first normally closed terminal S1, a first normally open terminal S2, and a first common terminal T1. The second switch K2 includes a second normally closed terminal S3, a second normally open terminal S4, and a second common terminal T2. The first common terminal T1 of the first switch K1 is connected to the right channel pin P2 of the earphone interface 10, the first normally closed terminal S1 is connected to a first resistance R1, and the first normally open terminal S2 is connected to the right channel output pin Rout of the audio codec chip 12. The second common terminal T2 of the second switch K2 is connected to the microphone pin P4 of the earphone interphone 10, the second normally closed terminal S3 is connected to an adapter power input terminal Adapter-in, and the second normally open terminal S4 is connected to the microphone input pin Mic of the audio codec chip 12. The adapter power input terminal Adapter-in is the same as an ordinary adapter power input terminal. The left channel output pin Lout of the audio codec chip 12 and the left channel pin P1 of the earphone interface 10 are electrically connected.

The first switch K1 and the second switch K2 each include a controlled terminal EN, the processing unit 11 includes a detect pin ADC-IN and a switch control pin SW, and the detect pin ADC-IN and the left channel pin P1 of the earphone interface 10 are electrically connected. When the electronic device 100 has power and either an earphone power line or an ordinary earphone is inserted into the earphone interface 10, the processing unit 11, through the detect pin ADC-IN, detects what has been inserted into the earphone interface 10. That is, the processing unit 11 detects whether the inserted device is an earphone power line such as the earphone power line 200 or an ordinary earphone such as an ordinary earphone 300 (see FIG. 3). Typically, it is a plug (see FIG. 2) of the earphone power line 200 that is inserted into the earphone interface 10, or a plug (see FIG. 3) of the ordinary earphone 300 that is inserted into the earphone interface 10. That is, the earphone interface 10 comprises a jack configured for engagingly receiving the plug of the earphone power line 200 or the plug of the ordinary earphone 300 at any one time In detail, the detect pin ADC-IN of the processing unit 11 is also connected to a voltage terminal V3.3 through a resistance R5. When the earphone power line 200 or the ordinary earphone 300 is inserted into the earphone interface 10, the left channel pin P1 of the earphone interface 10 has different load values, and the left channel pin P1 receives different voltages. Thus, the detect pin ADC-IN of the processing unit 11 detects the different voltages, and the processing unit 11, according to the different voltages detected by the detect pin ADC-IN, determines whether the ordinary earphone 300 or the earphone power line 200 is inserted into the earphone interface 10.

When the processing unit 11 determines that the earphone power line 200 is inserted into the earphone interface 10, the processing unit 11 outputs a first control signal to the controlled terminal EN of the first switch K1 and the controlled terminal EN of the second switch K2 through the switch control pin SW, to connect the common terminal T1 to the first normally closed terminal S1 of the first switch K1, and to connect the common terminal T2 to the second normally closed terminal S3 of the second switch K2. Thus, the earphone power line 200 provides power to the electronic device 100 through the earphone interface 10 and the second switch K2.

When the processing unit 11 determines that the ordinary earphone 300 is inserted into the earphone interface 10, a second control signal is output to the controlled terminal EN of the first switch K1 and the controlled terminal EN of the second switch K2 through the switch control pin SW, to connect the common terminal T1 to the first normally open terminal S2 of the first switch K1, and to connect the common terminal T2 to the second normally open terminal S4 of the second switch K2. Thereby, the left channel pin P1, the right channel pin P2 and the microphone pin P4 of the earphone interface 10 are connected to the left channel output pin Lout, the right channel pin Rout and the microphone input pin Mic of the audio codec chip 12, respectively. Thus, the earphone interface 10 outputs sound signals and receives sound signals normally.

FIG. 2 shows that the earphone power line 200 includes a detect ring Det, an enable ring Powen, a ground ring GND, and a power ring Power. The earphone power line 200 further includes a second resistance R2, a third resistance R3, and a fourth resistance R4. The values of the third resistance R3 and the fourth resistance R4 are equal, and the third resistance R3 and fourth resistance R4 are serially connected to the enable ring Powen. The detect ring Det is grounded through the second resistance R2.

When the earphone power line 200 is inserted into the earphone interface 10 of the electronic device 100, the detect ring Det, the enable ring Powen, the ground ring GND and the power ring Power of the earphone power line 200 are respectively connected to the left channel pin P1, the right channel pin P2, the ground pin P3 and the microphone pin P4 of the earphone interface 10. Thus, the fourth resistance R4 is connected in parallel with the first resistance R1, and the fourth and first resistances R4, R1 are serially connected to the third resistance R3. In one embodiment, when the input voltage of the enable ring Powen is 5V (volts), the resistance values of the first resistance R1, the third resistance R3 and the fourth resistance R4 are all 100 KΩ (kiloohms) When the fourth resistance R4 and the first resistance R1 in parallel satisfy a set value of a charging voltage of the electronic device 100 ((50/100+50)×5V=1.65V), the power from the earphone interface 10 is transferred to the adapter power input Adapter-in through the second switch K2, to thereby power the electronic device 100. That is, in this example, a threshold of the charging voltage is 1.65 V.

Figure 3:
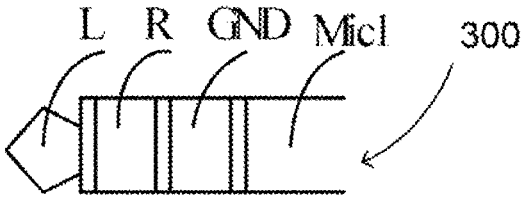
FIG. 3 is a schematic diagram of a plug of an ordinary earphone.

In addition, as previously mentioned, the processing unit 11, according to the voltage detected by the detect pin ADC-IN, determines whether the ordinary earphone 300 or the earphone power line 200 is inserted into the earphone interface 10. Specifically, as shown in FIG. 3, the ordinary earphone 300 includes a left channel ring L, a right channel ring R, a ground ring GND and a microphone ring Mic 1. The left channel ring L, right channel ring R, ground ring GND and microphone ring Mic1 of the ordinary earphone 300 respectively correspond to the detect ring Det, enable ring Powen, ground ring GND and power ring Power of the earphone power line 200.

The resistance value of the left channel ring L of the ordinary earphone 300 is often very small, for example 32 ohms In one embodiment, if the resistance values of the fifth resistance R5 and the second resistance R2 are both 10 KΩ, and with the voltage of the voltage terminal V3.3 being 3.3 V, when the ordinary earphone 300 is inserted into the earphone interface 10, and no matter whether the electronic device 100 has power or is unpowered, the left channel ring L, right channel ring R, ground ring GND and microphone ring Micl of the ordinary earphone 300 are electrically connected to the left channel pin P1, right channel pin P2, ground pin P3 and microphone pin P4 of the earphone interface 10, respectively, and the voltage detected by the detect pin ADC-IN of the processing unit 11 is very small, for example around 0 V.

In contrast, when the earphone power line 200 is inserted into the earphone interface 10, the detect ring Det, enable ring Powen, ground ring GND and power ring Power of the earphone power line 200 are respectively electrically connected to the left channel pin P1, right channel pin P2, ground pin P3 and microphone pin P4 of the earphone interface 10, and the detect pin ADC-IN of the processing unit 11 detects that the voltage is 1.65 V.

If neither an ordinary earphone 300 nor an earphone power line 200 are inserted into the earphone interface 10, the detect pin ADC-IN of the processing unit 11 detects that the voltage is 3.3 V.

Thus the processing unit 11, according to the voltage detected by the detect pin ADC-IN, can determine that either the ordinary earphone 300 or the earphone power line 200 has been inserted into the earphone interface 10.

When the earphone power line 200 is inserted into the earphone interface 10, as previously mentioned, the processing unit 11, according to the 1.65 V voltage, determines that the earphone power line 200 has been inserted into the earphone interface 10. Thus, the switch control pin SW outputs the first control signal to the controlled terminal EN of the first switch K1 and the controlled terminal EN of the second switch K2, to connect the first common terminal T1 to the first normally closed terminal S1 of the first switch K1, and to connect the second common terminal T2 to the second normally closed terminal S3 of the second switch K2, and thereby provide power to the electronic device 100.

When the processing unit 11 determines that the ordinary earphone 300 is inserted into the earphone interface 10, as previously mentioned, the processing unit 11 outputs the second control signal to the controlled terminal EN of the first switch K1 and the controlled terminal EN of the second switch K2 through the switch control pin SW, to connect the first common terminal T1 to the first normally open terminal S2 of the second switch K2, and to connect the second common terminal T2 to the second normally open terminal S4 of the second switch K2. Thereby, the left channel pin P1, right channel pin P2 and microphone pin P4 of the earphone interface 10 are connected to the left channel output pin Lout, right channel output pin Rout and microphone input pin Mic of the audio codec chip 12, respectively. Thus, the earphone interface 10 can output sound signals and receive sound signals normally.

In other embodiments, the electronic device 100 further includes a first capacitance C1 connected between the left channel output pin Lout of the audio codec chip 12 and the left channel pin P1 of the earphone interface 10, and an inductance L1 connected between left channel pin P1 of the earphone interface 10 and the detect pin ADC-IN of the processing unit 11. When the earphone power line 200 is inserted into the earphone interface 10, the first capacitance C1 weakens the direct current (DC) voltage outputted by the left channel output terminal Lout, and the inductance L1 weakens the alternating current (AC) voltage outputted by the left channel output terminal Lout, to avoid causing interference to the detect pin ADC-IN of the processing unit 11.

In other embodiments, the earphone power line 200 further includes a resistance-capacitance (RC) filter circuit, which includes a second capacitance C2 and the second resistance R2. Thus, when the earphone power line 200 is inserted into the earphone interface 10, the RC filter circuit filters a right channel audio signal outputted by the right channel output pin Rout of the earphone interface 10, which prevents circuit feedback to the audio codec chip 12 and avoids burning or overheating the audio codec chip 12.

In some embodiments, the electronic device 100 may be a mobile phone, an electronic photo frame, an electronic book, a digital camera, or another kind of portable electronic device.

In summary, when the electronic device 100 has power, the earphone interface 10 of the electronic device 100 is able to selectively either output an audio signal through the ordinary earphone 300, or receive input power for the electronic device 100 from the earphone power line 200. When the electronic device 100 is without power, the earphone interface 10 of the electronic device 100 can receive input power from the earphone power line 200 and thereby power the electronic device 100. The dual purpose earphone interface 10 reduces the number of interfaces of the electronic device 100, and accordingly decreases the cost of the electronic device 100.

What is claimed is:

1. An electronic device capable of being powered through an earphone interface, the electronic device comprising:

an earphone interface, comprising a left channel pin, a right channel pin, a ground pin, and a microphone pin;

an audio codec chip, comprising a left output channel pin, a right output channel pin, and a microphone input pin, wherein the left output channel pin of the audio codec chip is electrically connected to the left channel pin of the earphone interface;

a first switch, comprising a first normally open terminal, a first normally closed terminal, a first common terminal, and a first controlled terminal, wherein the first normally closed terminal of the first switch is grounded through a first resistance, the first normally open terminal is connected with the right channel output pin of the audio codec chip, and the first common terminal is connected with the right channel pin of the earphone interface;

an adapter power input terminal;

a second switch, comprising a second normally closed terminal, a second normally open terminal, a second common terminal, and a second controlled terminal, wherein the second normally closed terminal of the second switch is connected with the adapter power input terminal, the second normally open terminal is connected with the microphone input pin of the audio codec chip, and the second common terminal is connected with the microphone pin of the earphone interface; and a processing unit, comprising a detect pin and a switch control pin, wherein the detect pin is electrically connected with the left channel pin of the earphone interface, and the switch control pin is electrically connected with both the first controlled terminal and the second controlled terminal.

2. The electronic device of claim 1, wherein when the electronic device has no power and an earphone power line is inserted into the earphone interface, the first switch maintains connection between the first common terminal and the first normally closed terminal, and the second switch maintains connection between the second common terminal and the second normally closed terminal, such that the electronic device is powered from the earphone power line through the second switch.

3. The electronic device of claim 1, wherein when the electronic device has no power and in response to an earphone power line or an earphone being inserted into the earphone interface, the detect pin of the processing unit determines whether it is the earphone power line or the ordinary earphone that has been inserted according to either of two different detected voltages corresponding to insertion of the earphone power line and insertion of the earphone, respectively.

4. The electronic device of claim 3, wherein in response to the detect pin of the processing unit detecting a first voltage, the processing unit determines that the earphone power line has been inserted into the earphone interface, and outputs a first control signal to the first controlled terminal of the first switch and the second controlled terminal of the second switch through the switch control pin, to connect the first common terminal to the first normally closed terminal of the first switch and to connect the second common terminal to the second normally closed terminal of the second switch, and thereby to power the electronic device from the earphone power line through the earphone interface and the second switch.

5. The electronic device of claim 4, wherein in response to the detect pin of the processing unit detecting a second voltage different from the first voltage, the processing unit determines that the earphone has been inserted into the earphone interface, and outputs a second control signal to the first controlled terminal of the first switch and the second controlled terminal of the second switch through the switch control pin, to connect the first common terminal to the first normally open terminal of the first switch and to connect the second common terminal to the second normally open terminal of the second switch, such that the left channel pin, the right channel pin and the microphone pin of the earphone interface are connected to the left channel output pin, the right channel output pin and the microphone input pin of the audio codec chip, respectively, and the earphone interface outputs sound signals and receives sound signals through the earphone.

6. The electronic device of claim 5, wherein the detect pin of the processing unit is further electrically connected to a voltage terminal through a second resistance.

7. The electronic device of claim 3, wherein when the electronic device has power and in response to the earphone power line or the earphone being inserted into the earphone interface, the detect pin of the processing unit detects either of two different voltages corresponding to the left channel pin of the earphone interface having two different load values and different dividing voltage.

8. The electronic device of claim 7, wherein in response to the earphone power line being inserted into the earphone interface, the detect pin of the processing unit detects a first voltage; and in response to the earphone being inserted into the earphone interface, the detect pin of the processing unit detects a second voltage.

9. The electronic device of claim 1, further comprising:

an inductance, electrically connected between the left channel pin of the earphone interface and the detect pin of the processing unit; and a capacitor, electrically connected between the left channel pin of the earphone interface and the left channel output pin of the audio codec chip.

10. The electronic device of claim 1, wherein the earphone interface is configured for engagingly receiving a plug of an earphone power line or a plug of an earphone at any one time.

11. An earphone power line, comprising a detect ring, an enable ring, a ground ring, a power ring, a first resistance, a second resistance, and a third resistance, wherein the detect ring is grounded through the first resistance, and the second resistance and the third resistance are connected in series to the enable ring, and in response to the earphone power line being inserted into an earphone interface of an electronic device having no power, the detect ring detects a first voltage that matches a threshold of charging voltage of the electronic device, and the power ring is activated to power the electronic device through the earphone interface.

12. An earphone power line comprising a detect ring, an enable ring, a ground ring, a power ring, a first resistance, a second resistance, and a third resistance, wherein the detect ring is grounded through the first resistance, and the second resistance and the third resistance are connected in series to the enable ring, and in response to the earphone power line being inserted into an earphone interface of an electronic device with the earphone interface comprising a left channel pin, a right channel pin, a ground pin and a microphone pin, the detect ring, the enable ring, the ground ring and the power ring of the earphone power line are respectively connected to the left channel pin, the right channel pin, the ground pin, and the microphone pin of the earphone interface of the electronic device.

* * * * *